United States Patent [19]

Mushell

[11] Patent Number: 4,503,962

[45] Date of Patent: Mar. 12, 1985

[54] COIN-OPERATED TICKET RELEASE MECHANISM

[76] Inventor: Joshua Mushell, 1368 Vrain, Denver, Colo. 80204

[21] Appl. No.: 378,848

[22] Filed: May 17, 1982

[51] Int. Cl.[3] ..... G07F 5/04

[52] U.S. Cl. ..... 194/1 G; 194/93

[58] Field of Search ..... 194/1 G, 92, 93, DIG. 2

[56] References Cited

U.S. PATENT DOCUMENTS

| | | | |
|---|---|---|---|
| 1,736,710 | 11/1929 | Hulin | 194/93 |
| 2,067,248 | 1/1937 | Smythe | 194/92 X |
| 2,178,276 | 10/1939 | Breither | 194/97 |
| 2,237,573 | 4/1941 | Osborne et al. | 74/128 |
| 3,231,059 | 1/1966 | Hall | 194/92 |
| 3,460,663 | 8/1969 | Schmitt et al. | 194/92 |
| 3,872,958 | 3/1975 | Greenwald et al. | 194/1 R |
| 3,887,054 | 6/1975 | Allen | 194/92 |
| 3,912,063 | 10/1975 | Hall | 194/92 |

FOREIGN PATENT DOCUMENTS

| | | | |
|---|---|---|---|
| 1413065 | 11/1975 | United Kingdom | 194/93 |

*Primary Examiner*—F. J. Bartuska

*Attorney, Agent, or Firm*—John E. Reilly

[57] ABSTRACT

A coin-operated ticket dispenser mechanism is of the type having a plurality of coin-activated slide units arranged in side by side relation and are slidable in unison through guide slots formed in the housing for the dispenser mechanism with a slide member on each unit reciprocal between a first extended position and a second retracted position when a series of coins are deposited in the slide members. A rigid connecting bar serves to interconnect the slide members to cause the members to move only in unison between the first and second positions, and a roller member at one end of the rigid connecting bar moves into engagement with a release member on the dispenser mechanism so as to activate the mechanism only in response to movement of the slide members over a preselected distance to the first extended position so as to indicate that the proper number and denomination of coins have been deposited.

5 Claims, 6 Drawing Figures

COIN-OPERATED TICKET RELEASE MECHANISM

This invention relates to coin-operated vending machines; and more particularly relates to coin-operated mechanisms of the type which require positive mechanical engagement between a slide member and release mechanism in the dispensing of articles.

BACKGROUND AND FIELD OF INVENTION

Coin-controlled mechanisms have been devised for the purpose of automated vending of articles. This invention is concerned particularly with coin-controlled mechanisms which employ plural slide members and which require some form of positive or mechanical actuation of a release mechanism to dispense articles. In the use of plural slides, customarily each slide is provided with one or more coin slots or receptacles to accept predetermined denominations of coins, the sum of which represents the total amount required for purchase of an item. In this respect, the present invention is best typified by its use in controlling the dispensing of tickets, such as, to gain entry to a parking lot. Where the coins are deposited, the coin slides require positive movement to deposit the coins within a housing or receptacle which is locked to prevent unauthorized access to the money. When the proper denomination is deposited, the coin slides are free to advance to a position moving another part or element into direct engagement with a release mechanism to dispense the ticket or other item.

In the past, difficulty has been experienced in the use of plural coin slides, since under repeated use and wear it is difficult to maintain proper alignment between the slides and to assure that the full amount of money has been placed in each of the slides to trigger the release mechanism. Even minor shifting or displacement of the slides as well as any looseness or play in the slide mechanism or activating members for the release mechanism may result in malfunctioning of the equipment. At the same time it is highly desirable that the equipment be simple to assemble, maintain and operate and to the extent that it is able to withstand severe abuse to the extent of vandalism without malfunctioning.

Of the systems designed in the past, U.S. Pat. No. 2,067,248 to Smythe, Jr. is directed to a multiple coin slide with an actuator mechanism and which is intended and designed to permit substitution of different slides to accept different coin denominations. U.S. Pat. No. 2,237,573 to Osborne et al. similarly is directed to a multiple coin slide mechanism wherein the slides are secured together by a common actuator as is true of the patent to Smythe et al. referred to earlier. U.S. Pat. No. 3,460,663 to Schmitt et al. utilizes plural coin slides arranged in juxtaposed relation to one another but the slides are capable of movement independently of one another and do not employ a common connector element therebetween. U.S. Pat. No. 3,872,958 to Greenwald et al. employs a bar on a slide mechanism, the ends of which are covered with a nylon material to minimize wear and includes one end which is intended to engage a portion of a starting or release mechanism. Other representative patents directed to single or multiple slide arrangements in coin-operated vending machines are those to Hall, Nos. 3,231,059 and 3,912,063, Breither No. 2,178,276 and Allen No. 3,887,054.

SUMMARY OF THE INVENTION

It is therefore an object of the present invention to provide for a novel and improved coin-controlled mechanism which requires a minimum of maintenance, is easy to install, reduces losses from breakdown and customer tampering and is not readily subject to malfunctioning on account of misalignment or wear.

Another object of the present invention is to provide for a novel and improved coin-controlled mechanism which is conformable for use in various types of vending and dispensing machines, is of rugged construction and extremely reliable in use.

It is a further object of the present invention to provide for a novel and improved method and means for interconnecting plural coin slides in such a way as to assure that the coin slides will operate in unison to effect release of an article to be dispensed and which will permit continuous use with minimum wear or misalignment, requires a minimum number of parts, is compact and can be retrofit to existing mechanisms.

In accordance with the present invention there has been devised a novel and improved coin-controlled slide mechanism of the type which is specifically adapted for use with a plurality of coin-activated slide units which are arranged in juxtaposed relation to one another and, upon insertion of a predetermined denomination or combination of coins are slidable in unison through a guide slot in a housing, each of the slide units having a slide plate reciprocal through a guide slot for movement between a first inwardly extended position into the housing and a second retracted position out of the housing. A release mechanism which includes at least one release arm or other member is adapted to be activated in response to movement of the coin-activated slide units over a preselected distance whereby to indicate that the proper denomination of coins have been inserted in the units. In combination therewith, the present invention employs a rigid connecting means between the inner ends of the slide units so as to rigidly interconnect the slides for movement in unison, and an extension roller is journaled to project from the rigid connecting means or slides for engagement with a release member so as to activate the release mechanism when the slide units have advanced over a preselected distance. Preferably the rigid connecting means is defined by a heavy duty connecting bar which traverses the inner ends of the slides and is rigidly connected to the slides so as to prevent shifting or misalignment therebetween when one or both of the slides are depressed following insertion of the requisite number and denomination of coins. The roller means comprises a roller element preferably composed of a nylon material journaled on a shaft which projects laterally from one end of the rigid connecting bar, or in other words, to one side of one of the slide mechanisms so as to be movable into engagement with the release member upon inward advancement of the slides.

In the preferred form of invention, the rigid connecting bar and journaled roller are employed with a release mechanism of the type employing a pair of actuating or release arms which incline downwardly into the path of movement of the roller and which in response to engagement by the roller will initiate advancement of an escapement mechanism to control dispensing of the ticket through a separate part of the housing.

Once the release mechanism has been activated and the slide units have reached their inward limit of movement, return springs are so positioned between the rigid connecting bar and slide units as to assure immediate return to the original retracted position so as to be in position to accept the proper number of coins for the next operation.

The above and other objects, advantages and features of the present invention will become more readily understood and appreciated from a consideration of the following detailed description when taken together with the accompanying drawings in which:

DETAILED DESCRIPTION OF PREFERRED EMBODIMENT

Figure 2:
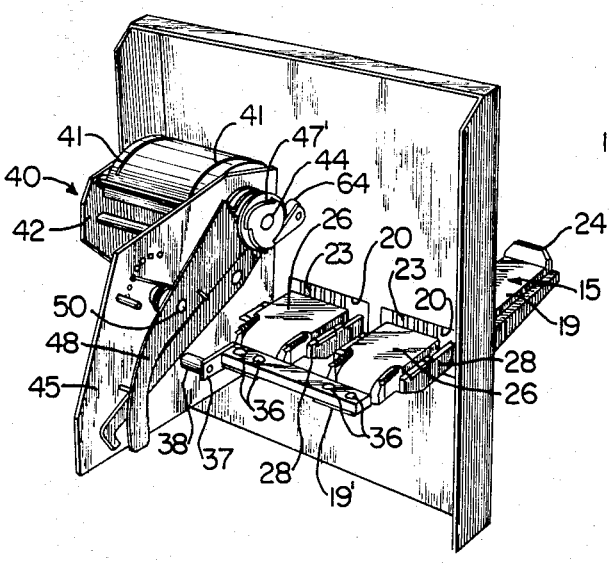
FIG. 2 is a rear perspective view of a portion of the mechanism shown in FIG. 1 and illustrating the preferred form of ticket release mechanism in accordance with the present inventon.
Figure 1:
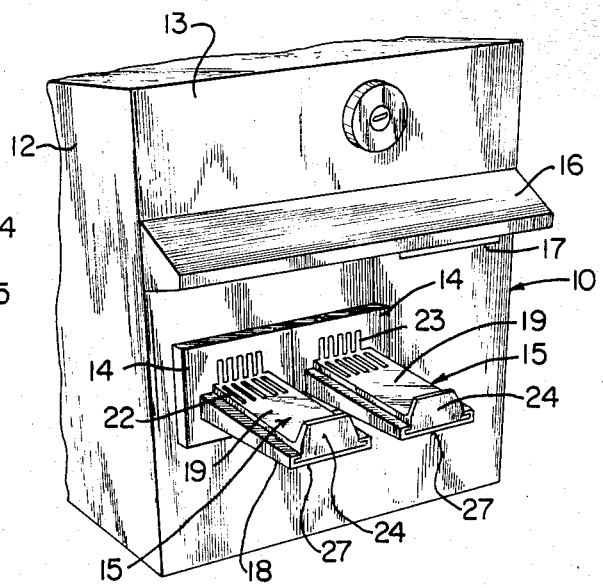
FIG. 1 is a front perspective view of a conventional form of coin-operated ticket release mechanism.
Figure 3:
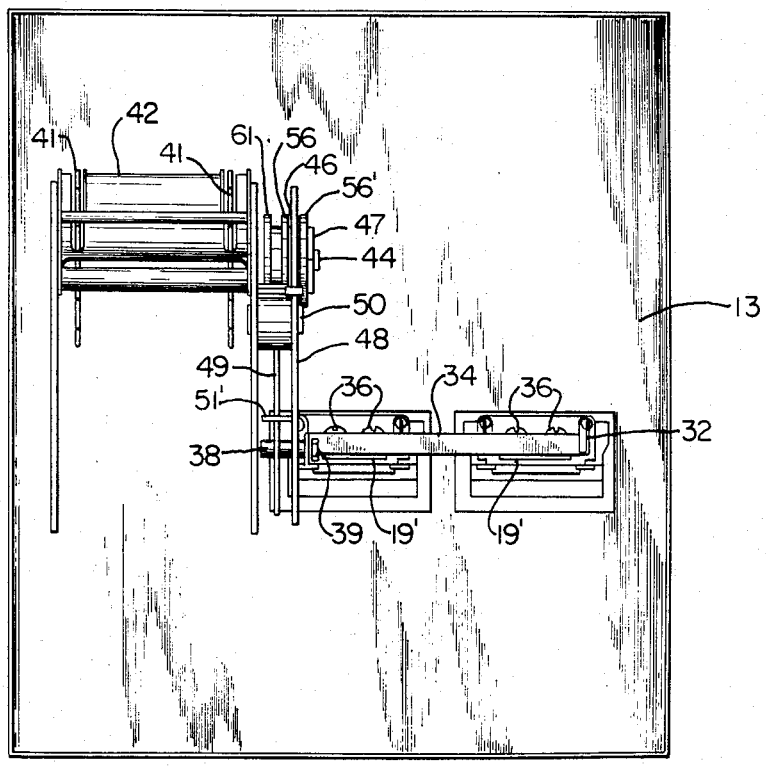
FIG. 3 is a rear view in elevation of the preferred form of ticket release mechanism shown in FIG. 2.
Figure 4:
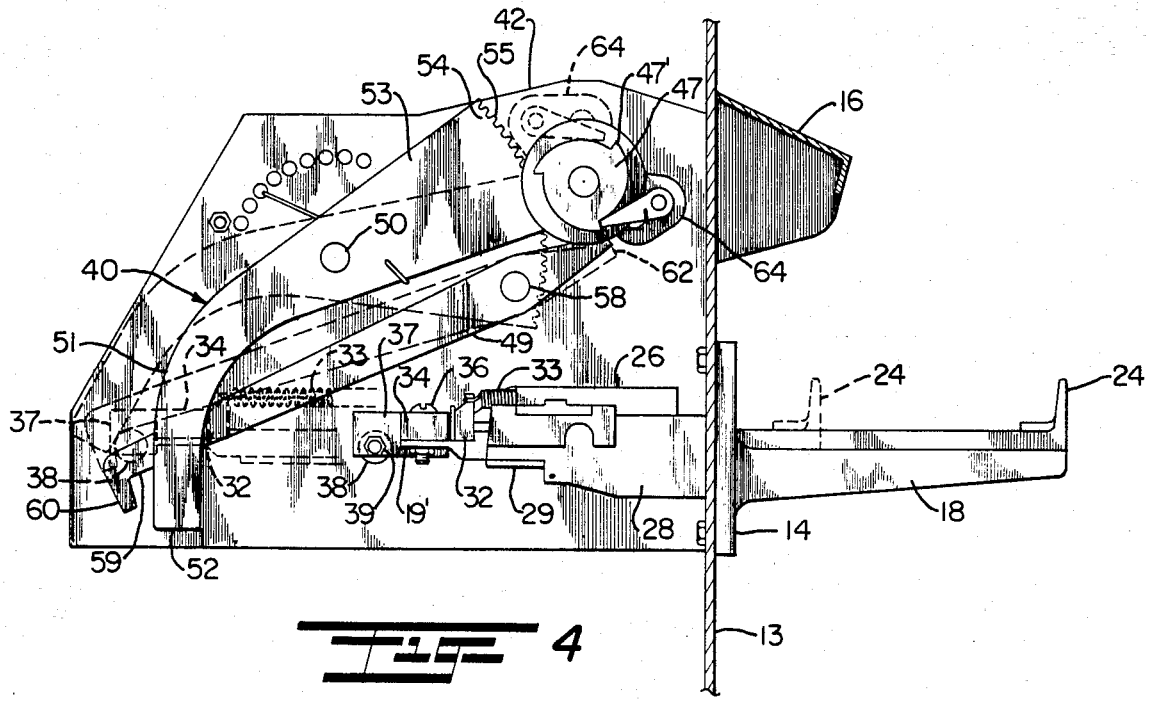
FIG. 4 is a side view illustrating partially in section the entire ticket dispenser mechanism.
Figure 5:
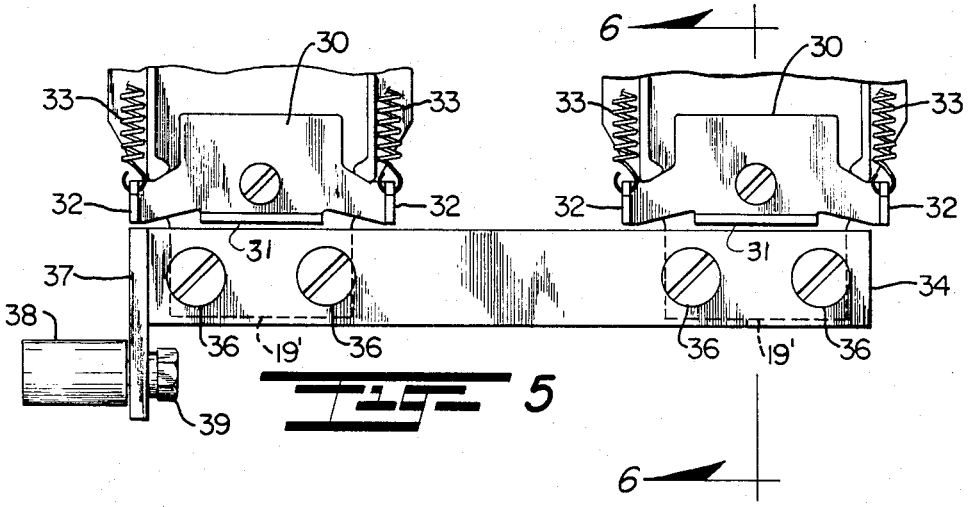
FIG. 5 is an enlarged view in elevation of the preferred form of connector bar and roller-type activating member in accordance with the present invention.
Figure 6:
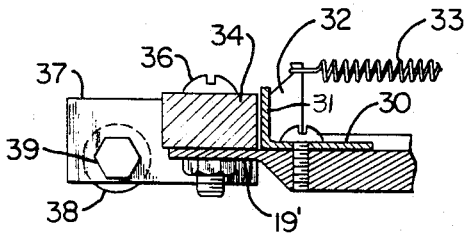
FIG. 6 is an end view of the bar and roller illustrated in FIG. 5.

Referring in more detail to the drawings, there is shown by way of illustrative example in FIG. 1 a conventional form of vending machine 10 having a cabinet or housing 12, front panel 13 and mounting flanges 14 positioned on the front panel to support a pair of coin chutes 15 in juxtaposed relation to one another. In the form of vending machine illustrated, a hood 16 projects forwardly from the front panel and which is spaced above the coin chutes as well as a ticket dispensing slot 17 so that when the proper denomination and amount of coins are placed in the coin chutes 15 the chutes 15 may be extended inwardly through the front panel to cause activation of a release mechanism to be described for dispensing of a ticket. Thus while the preferred form of invention to be hereinafter described is shown as it is adapted for use in a ticket dispensing mechanism, it should be understood from the outset that the invention is equally conformable for use in conjunction with various coin-operated vending machines such as laundry equipment, games, food vending machines and the like. Moreover, it is equally adaptable for use with one or more coin chutes each of which may be provided with one or more coin slots or receptacles.

In the preferred form, as seen from a consideration of FIGS. 2 to 5, each coin chute comprises a stationary, elongated open frame 18, a slide member or plate 19 which is supported in the frame 18 and is adapted for extension through a horizontal opening or enlarged horizontal channel or slot 20 which is formed in each mounting flange 14. A series of horizontally extending slots 22 extend in closely spaced parallel relation to one another across the width of each slide plate or member and are aligned with a corresponding number of closely spaced vertical slots 23 in each of the mounting flanges. A finger grip 24 is positioned at the front or outer distal end of each slide plate and which finger grips project upwardly at the distal ends of the slide plates to facilitate manual gripping and longitudinal sliding movement of the plates forwardly or inwardly through the main slots 20 in the mounting flanges 14. In a conventional manner, when the slide plates 19 are disposed at their outer coin-inserting positions, the slots 22 will accept coins of a predetermined denomination from a customer. Once the proper denomination and number of coins have been placed in each of the respective slots in accordance with instructions furnished on the front panel, the slide plates can be pushed inwardly by manipulation of the finger grips so that the coins are carried along with the plates through the vertical slots 23 and into the interior of the housing 12 where they are dropped into or through a suitable coin receptacle beneath the slots 22 when the slide members approach the end of their rearward or inward movement through the housing.

As is well known, in the absence of coins of proper denomination in the slots at each coin chute 15, it is important that suitable limit stop mechanism, customarily referred to as "anti-cheat" devices be effective to limit the inward movement of both chutes 15 and to prevent the improper dispensing of a ticket. As such, various types of anti-cheat devices may be employed so that if the proper denomination of coins is not placed in the slots of the coin chutes the inward movement of the slide plates will be limited to a position short of that necessary either to deposit the coins into the receptacle or to activate the ticket dispensing mechanism, and as such forms no part of the present invention.

Considering in somewhat more detail the disposition and arrangement of the coin chutes and associated slide members 19 it will be noted that the interior portion of each frame 18 has a cover panel 26 which cooperates in guiding the inward movement of the coins as a preliminary to their being deposited within the housing. The frame portion 18 includes a base 27 upon which the slide member rests exteriorly of the front panel; however, the base portion terminates inside the front panel, and the remainder of the frame which projects interiorly of the housing is defined by a pair of spaced, elongated support members or guides as designated at 28 between which the slide member 19 is guided. In turn, each slide member 19 has guide tracks 29 projecting from opposite sides which ride along the supports of the frame 28 interiorly of the housing, each slide member being of flat or narrow elongated rectangular construction and terminating at its inner end in a narrow flat extension plate 19' which is directed normal or transversely to the length of the slide member. In addition, each slide member is provided with a bracket 30 at its inner end which is affixed to the inner end of the slide member and includes an upstanding transversely extending flange 31 together with upstanding flanges 32 on opposite sides of the flange 31. The side flanges 32 serve as upstanding supports for connection of the inner ends of a pair of return springs 33 which extend forwardly from the flanges 32 and are affixed at their forward ends to terminals, not shown, located on the stationary side supports 28 of the frame 18.

In accordance with the present invention, the inner horizontal extension plates 19' are horizontally aligned with one another and are ganged together by a heavy-duty, solid rigid bar 34 which extends transversely of the length of the slide plates 19 and serves as a common means of rigidly interconnecting the inner ends of the slide plates together. Specifically the rigid bar 34 is of rectangular configuration and of uniform dimension throughout and is dimensioned to be of a length to traverse the combined width of the slide plates 19. The bar is affixed to each extension plate 19' by a pair of fasteners such as connecting bolts 36 which are passed vertically through aligned openings in the bar and plate, the aligned openings being positioned at opposite ends of each plate so that upon assembly and interconnection of the bar as described the connection therebetween is such that one plate 19 cannot slide or shift without corresponding movement of the other plate 19. For this purpose, the bar 34 is made to be relatively thick in relation to the slide plate 19 as well as the extension plate members 19' and is securely and permanently affixed to the extension plates so that under repeated usage and wear there will not be a tendency for the plates to undergo relative shifting with respect to one another. In addition, one end of the bar is provided with a side extension flange or plate 37 which projects inwardly from permanent attachment to the end of the bar to serve as a means of mounting a roller 38, the latter being journaled on a stub shaft 39 with the end of the shaft projecting through an opening in the side extension flange and being threaded for secure connection by means of a lock nut to the end of the bar. The roller serves the important function of activating a release mechanism for dispensing of tickets and generally designated at 40 as hereinafter described.

The release mechanism 40 as such is of conventional construction and therefore will not be described in detail other than to identify those parts which are activated in response to inward movement of the slide members 19. Briefly, the release mechanism comprises a ticket dispenser assembly mounted within a housing 42 and which contains sprocket drive elements 41 to advance each ticket through the opening 17 in the front panel 13. The sprocket elements are mounted on a common shaft 44 which projects through one end of the housing and through a vertical side or mounting panel 45 on one side of the housing. A ratchet wheel 46 is journaled on the shaft 44, and the escapement wheel 47 is keyed to the shaft 44 exteriorly of the vertical side panel 45 to impart rotation to the sprocket assembly under the control of a pair of release arms in the form of flat plate members 48 and 49 which are pivotally mounted on the side panel. The arms 48 and 49 coact with one another to control the movement of the ratchet and escapement wheels so as to impart rotation over a limited distance to the shaft 44 in advancing each ticket followed by the locking of the assembly after dispensing each ticket. To this end, the arm 48 serves as the ratchet control arm which is pivoted as at 50 at an intermediate point along the arm between a rearwardly and downwardly curving portion 51 which converges into a vertical, free end or leg portion 52 and a forwardly divergent portion 53 which terminates in an arcuate or convex end 54 having a plurality of teeth 55. The arm 48 is disposed in closely spaced parallel relation to the side panel with its forwardmost or leading convex end 54 inserted between a pair of disks 56 and 56' into intermeshing engagement with the teeth on the ratchet wheel 46. In turn, the coacting arm member 49 is straighter than the arm 48 and is pivoted as at 58 adjacent to its forwardmost or leading end with an elongated, rearwardly extending or trailing arm portion 59 inclining at a relatively low, gradual angle with respect to the arm 48 and terminating in an offset end portion 60 just rearwardly of the lower end of the arm 48. The forward or leading end of arm 49 projects forwardly from the pivot point 58 and tapers into a locking dog 62 which enters into an annular space or channel between disks 56 and 61 on the common shaft 44 to cooperate with the ratchet wheel 46 in controlling the movement of an escapement locking member 64. Again, the construction and arrangment of the release mechanism as such is conventional and therefore will not be described in any further detail other than to make clear the cooperating relationship between the arms 48 and 49 in controlling the movement of the escapement and release mechanism. Briefly, when the rearward end of the arm 49 is engaged by the rearwardly advancing roller 38 and caused to swing in an upward direction about its pivot 58, its trailing end 59 will advance into engagement with a transversely projecting pin 51' on the arm 48 and cause the arm 48 to pivot along with the arm 49. As a result, the convex end 54 of the arm 48 will rotate the ratchet wheel 46 in a counterclockwise direction whereby to swing the escapement locking member 64 into the raised position, shown dotted in FIG. 4, against the urging of a clutch spring, not shown, in the sprocket assembly. Movement of the escapement locking member 64 in a counterclockwise direction will rotate it into alignment with another tooth 47' on the escapement wheel 47 so that when the arms 48 and 49 are released by the roller, the stored up energy in the spring will cause the escapement control to reverse its movement and advance the wheel 47 in a clockwise direction whereby to rotate the shaft 44 and sprocket assembly in the dispenser housing and dispense a ticket. Thus the roller member 38 is operable within the limited confines or space afforded between the coin chute mechanism and side panel of the dispenser to move in a straight line direction into the gradually inclined arm 48 causing it to bear against the ratchet control arm 49 to impart a cocking motion to the escapement control member 64. This movement will continue until the roller is in substantial abutment with the lower leg of the ratchet control arm 49 which at that point is raised sufficiently that continued pressure by the roller against the leg will cause its continued upward motion. Upon release of the slide members 19, they are free to return to their original retracted position; and as the roller 38 moves away from the arm members 48 and 49, the stored up energy in the dispenser or spring will cause rapid clockwise motion of the escapement wheel 47 in dispensing a ticket and return movement of the arms 48 and 49 to the position as shown in full in FIG. 4.

It should be understood that while the particular mechanism described for activating the dispenser employs a pair of release arm members 48 and 49, the roller member 38 as described can be as effectively used to engage other elements in releasing a ticket or to perform other operations, such as, releasing a chute for dispensing food articles or drinks. Most importantly, the roller element is capable of withstanding extreme wear after repeated engagement with the coacting arms and is firmly supported in its movement by the connecting bar 34 between the inner ends of the slide members. It will be recognized also that projecting elements other than a roller may be employed to effect engagement with the arms in response to inward movement of the slide members. Nevertheless the roller is especially effective in minimizing wear either on the roller surface or on the arms while effecting a postitive release of the dispenser mechanism.

For the purpose of illustration and not limitation, assuming that the total amount required for dispensing a ticket is $ 2.50 and each coin slot is designed for placement of a quarter, there being five slots in each slide member. Thus, the dispenser mechanism may be activated by inserting a total of ten quarters and pushing either one of both of the finger grips inwardly toward the housing until the coin slots reach the coin depositing position. As the slide members are pushed inwardly, the roller will follow their inward movement to advance against the arm 48 and, under continued movement, will initiate downward movement of the ratchet control arm 49 against the ratchet wheel causing it to rotate in a counterclockwise direction and to lift the escapement control 64 to engage a tooth on the escapement wheel. When the slide members are released, the force of the clutch spring on the control shaft 44 will cause a reverse movement of the escapement control member 64 to drive the wheel in a clockwise direction thereby imparting rotation to the control shaft and dispenser assembly to advance a ticket through the slot 17 in the housing. Movement of the escapement wheel and control member 64 will impart through the ratchet wheel reverse movement to the coacting arm members causing them to return to their original position in preparation for the next cycle. Simultaneously the return springs 33 will cause the slide members 19 and attached roller 38 to return to their original retracted position.

In the arrangement described, the coacting arms 48 and 49 are arranged in closely spaced parallel relation to one another and to the vertical side panel 45 so that the limited space is afforded for activation of the arms and the ticket dispensing mechanism. The combination bar and roller as described affords a particularly effective means of positively activating the arms 48 and 49 within the limited space afforded between the slide members and side panel 45, since the bar 44 will operate to rigidly connect the slide members together so as to avoid any shifting or misalignment therebetween while at the same time rigidly supporting the roller for advancement into and away from engagement with the coacting arms 48 and 49. The roller is preferably composed of a low coefficient of friction material on its roller surface, such as, nylon or teflon which will minimize any tendency of the elongated narrow arms to groove or score the roller surface. In turn, the bracket member 30 on each slide member is operative both to support and reinforce the common connecting bar 34 and to support the return springs 33 for extension in a lengthwise direction along opposite sides of the slide plate members 19 without interfering with the movement either of the slide plate members or of the coacting arms 48 and 49.

It will be evident from the foregoing that the coin chute mechanism may be of the type which can be modified to accept different denominations of coins or different combinations of coins as desired for a particular sum total or amount required for dispensing a ticket. Moreover, the bar and roller assembly as described are readily conformable for use in controlling the activation of various types of release or dispenser mechanisms in vending machines. In this relation, the roller may be modified in size or its mounting location with respect to the bar or to the slide members. Still further, the particular mounting and location of the return springs may be varied in accordance with the return force required to retract the slide members to their original or starting position. Thus, for instance, a single return spring may be mounted for extension intermediately of the bar between the slide members. However, the disposition of a series of return springs in the manner shown and described has been formed to be preferable for imparting a uniform return force on the bar in retracting the slide members.

It is therefore to be understood that various modifications and changes may be made in the construction and arrangement of parts comprising the preferred embodiment of the present invention without departing from the spirit and scope of the invention as defined by the accompanying claims and any reasonable equivalents thereof.

I claim:

1. In a coin-operated ticket dispenser apparatus wherein a plurality of coin-activated slide units are arranged in juxtaposed relation to one another and, upon insertion of a predetermined combination of coins are slidable in unison through a guide slot formed in a housing, each unit having a slide plate reciprocal through said guide slot for extension and retraction between a first inwardly extended position into said housing and a second retracted position away from said housing, and a ticket advance mechanism located within said housing including a rotary drive shaft having one end projecting through a mounting panel with a swingable release arm member positioned on said one end of said shaft to control its rotary movement for advancement of a ticket from said housing, said release arm member disposed in spaced parallel relation between said mounting panel and said slide units, the combination therewith comprising:

an elongated rigid connecting bar extending across inner ends of said slide plate members in a direction transversely of the slidable movement of said slide plates, said connecting bar traversing the substantial width of said slide plates within said housing, and fastener means rigidly interconnecting said connecting bar to said slide plate members for movement of said slide plate members in unison through said housing;

roller means projecting laterally in offset relation to one end of said connecting bar and beyond one side of said slide plates toward said mounting panel, said roller means movable into engagement with said release arm member in response to sliding movement of said slide plate members in unison to said first inwardly extended position within said housing whereby to impart rotary movement to said shaft over a distance sufficient to advance a ticket from said housing; and return spring means extending between said connecting bar means and said housing to impart return movement to said slide plate members in unison from said first inwardly extended position to said second retracted position.

2. In a coin-operated machine according to claim 1, said slide plate members having extension plates at inner ends thereof, said bar being of elongated generally rectangular configuration, and fastening means rigidly interconnecting said bar to said extension plates.

3. In a coin-operated ticket dispenser apparatus according to claim 1 including a bracket mounted on each of said slide plate members outwardly of said rigid connecting bar means and including an upstanding flange abutting one side of said rigid connecting bar means.

4. In a coin-operated dispenser apparatus according to claim 3, each bracket including upstanding side flanges, and said return spring means including a return spring having one end secured to each of said side flanges.

5. In a coin-operated dispenser apparatus according to claim 1, said roller means defined by an annular member composed of a low coefficient of friction material and a shaft upon which said annular member is journaled for free rolling movement.

* * * * *